US007823497B2

(12) United States Patent
Östberg et al.

(10) Patent No.: US 7,823,497 B2
(45) Date of Patent: Nov. 2, 2010

(54) COUNTERMASS AND COUNTERMASS WEAPON

(75) Inventors: Jonas Östberg, Eskilstuna (SE); Åke Jansson, Eskilstuna (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 11/357,191

(22) Filed: Feb. 21, 2006

(65) Prior Publication Data

US 2007/0068374 A1 Mar. 29, 2007

(30) Foreign Application Priority Data

Mar. 21, 2005 (EP) ..... 05445016

(51) Int. Cl.
*F41A 1/08* (2006.01)

(52) U.S. Cl. ..... 89/1.701; 89/1.816

(58) Field of Classification Search ..... 89/1.7–1.706, 89/1.816; 102/437; 42/1.06
See application file for complete search history.

(56) References Cited

U.S. PATENT DOCUMENTS

| | | | | |
|---|---|---|---|---|
| 4,132,148 | A * | 1/1979 | Meistring et al. | 89/1.701 |
| 5,337,648 | A * | 8/1994 | Brage | 89/1.704 |
| 5,551,330 | A * | 9/1996 | Reuche | 89/1.701 |
| 6,286,408 | B1 | 9/2001 | Sanford et al. | |
| 2005/0217468 | A1* | 10/2005 | Ax et al. | 89/1.704 |
| 2006/0249011 | A1* | 11/2006 | Ax et al. | 89/1.701 |

FOREIGN PATENT DOCUMENTS

| | | | |
|---|---|---|---|
| FR | 1 405 733 | A | 7/1965 |
| GB | 1023998 | A | 3/1966 |
| GB | 2 129 105 | A | 5/1984 |
| GB | 2129105 | A * | 5/1984 |
| SE | 444 722 | B | 4/1986 |
| WO | WO 2004/109212 | A1 | 12/2004 |

OTHER PUBLICATIONS

Search Report from European patent application EP 05 44 5016.

* cited by examiner

*Primary Examiner*—J. Woodrow Eldred
*Assistant Examiner*—Gabriel J Klein
(74) *Attorney, Agent, or Firm*—Venable LLP; Eric J. Franklin

(57) ABSTRACT

A countermass for use in a weapon to balance the forces arising when a launch able unit is launched from a launcher tube of the weapon. The countermass includes a first container enclosing a liquid. A countermass weapon includes a launcher tube open or openable in both ends. The launcher tube houses a launch able unit, a countermass including a first container enclosing a liquid, a pressure chamber, and a propellant charge that upon firing and combustion of the charge in cooperation with the pressure chamber and the countermass accelerates the launch able unit forwards in the tube at the same time as the countermass accelerates backwards in the tube. The first container is made of a non-rigid material. A second container is provided to cover or almost cover the first container. The second container is designed with damping characteristics.

7 Claims, 3 Drawing Sheets

COUNTERMASS AND COUNTERMASS WEAPON

CROSS-REFERENCE TO RELATED APPLICATIONS

This application claims priority under 35 USC §119 to European patent application No. 05445016.8 filed on 21 Feb. 2005.

FIELD OF THE INVENTION

The present invention relates to a countermass for use in a weapon to balance the forces arising when a launchable unit, such as a rocket, a projectile, a shell or the like, is launched from a launcher tube of the weapon, the countermass comprising a first container enclosing a liquid. The invention also refers to a countermass weapon comprising a launcher tube open or openable in both ends, the launcher tube housing a launchable unit such as a rocket, a projectile, a shell or the like, a countermass comprising a first container enclosing a liquid, a pressure chamber, and a propellant charge that upon firing and combustion of the charge in cooperation with the pressure chamber and the countermass accelerates the launchable unit forwards in the tube at the same time as the countermass accelerates backwards in the tube.

BACKGROUND OF THE INVENTION

An example of a countermass and a countermass weapon according to the above is previously known from SE patent 8205956-9 (publication number 444 722). According to said patent the liquid is enclosed in a shell construction in the shape of a plastic container. It is important that such a container cracks in a controlled manner. To this end measures have been done to improve the cracking procedure for instance by introducing fractural impressions. Nevertheless it is a problem that the container may crack in an uncontrolled way mainly due to non-cracking in the intended fragmentations. This may result in that fragments having a high velocity are ejected backwards from of the launcher tube resulting in that the requirements on the back blast area not are fulfilled.

SUMMARY OF THE INVENTION

The object of the invention is to obtain a countermass and a countermass weapon that fulfils the requirements concerning back blast area and thus preventing generation of harmful high velocity fragments reaching an area to be safe a distance behind the weapon. A considered safety distance behind is often about 20 meters.

The object of the invention is obtained in that the first container enclosing the liquid is made of a non-rigid material and that a second container is provided to cover or almost cover the first container, the second container being designed with damping characteristics.

When firing such a weapon, the countermass behaves in a favourable way. The second container designed with damping characteristics is rapidly split into pieces and slowed down behind the weapon. The first container of non-rigid material is also rapidly destroyed. Accordingly there is no harmful ejection of material behind the weapon beyond a standard safety distance. The use of a first container of a non-rigid material also makes it possible to keep down costs for manufacturing the countermass and the time to produce different variants of countermass containers. It is easy to adapt the first container to different shapes of the inner walls of the outer second container. A new mould for the outer second container designed with damping characteristics can also be prepared within a short period. Furthermore the weight of the countermass containers is low so that the total weight of the weapon can be reduced.

According to a favourable development of the countermass the first container is made of a plastic foil. Another favourable development proposes that the first container is made of a metal foil, such as aluminium foil. The proposed foils are easy to adapt to almost any shape of the inner walls of the second container and are easily torn up behind the weapon avoiding harmful effects.

According to another favourable development the second container designed with damping characteristics is made of foam plastic. Such a material has turned out to rapidly split into pieces and slow down behind the weapon.

According to still another development a liquid binding material is enclosed in the first container. A suitable liquid binding material specifically proposed in this connection is a material of Oasis type.

According to yet another development it is proposed that the first container is designed as a sealable bag. The bag can be provided with an inherent sealing which is sealed when the bag has been filled with liquid and if adequate a liquid binding material. The bag can also be sealed by means of the covering second outer container.

Preferably the second container consists of two essentially rotary symmetrical sections joint to each other after insertion of the first container. Such a designed second container facilitates the enclosure of the first container and also contributes to the sealing of the first container. Advantageously a peripheral part of the first container is clamped in between the sections of the second container.

According to one proposed embodiment the countermass of the weapon is fixed to the launcher tube by means of a clamping effect. According to another embodiment the countermass is fixed to the launcher tube by means of a screw joint. Both embodiments propose simple solutions how to arrange the countermass in the launcher tube.

In a particular embodiment the launchable unit is a rocket and in another embodiment the launchable unit is a projectile. The use of a countermass as claimed in these application fields enables a limitation of harmful fragments behind the weapon at the same time as the rocket or projectile is adequately launched from the launcher tube when firing.

BRIEF DESCRIPTION OF THE DRAWINGS

The invention will now be described in more detail by means of an embodiment with reference to the accompanying drawings in which.

DETAILED DESCRIPTION

Figure 1:
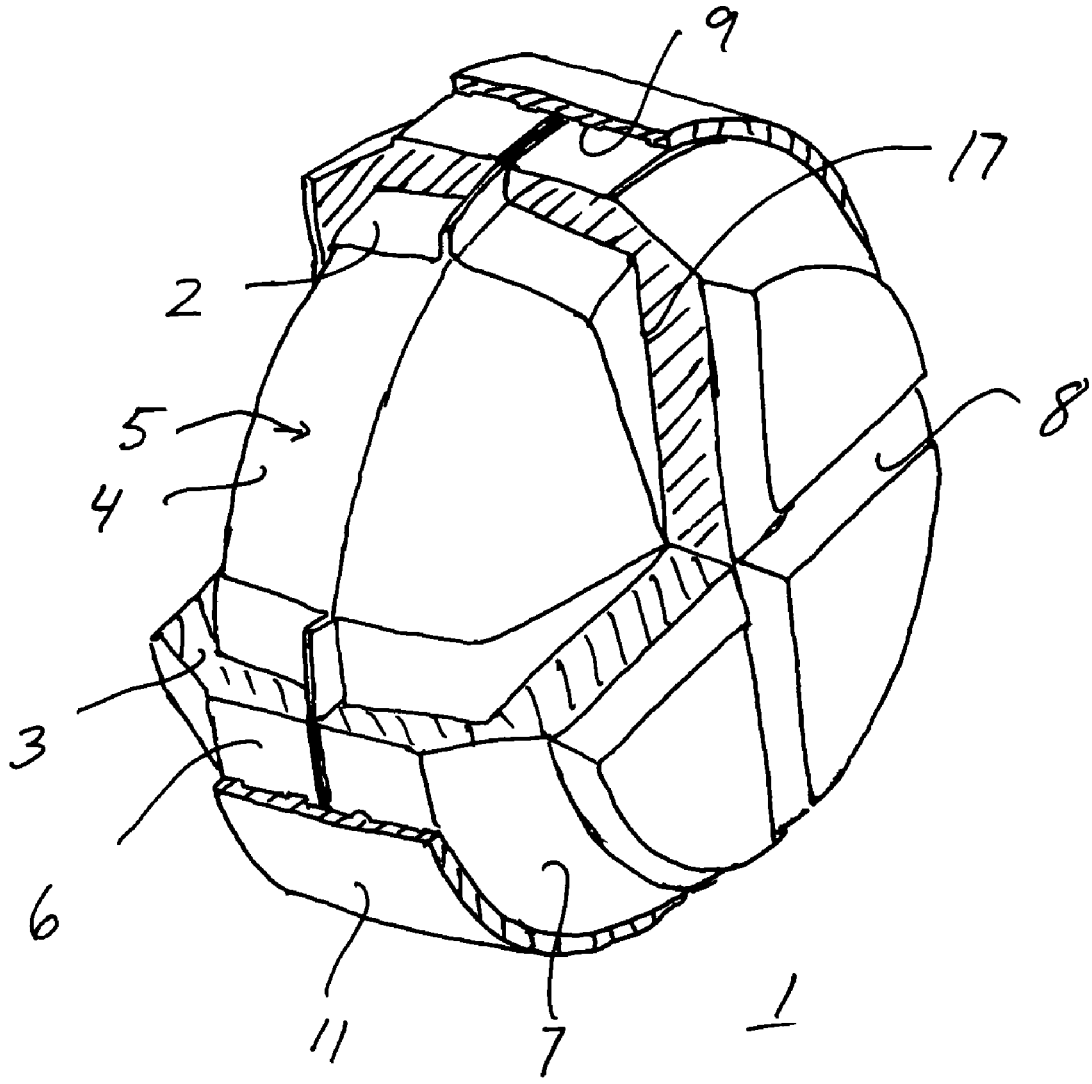
FIG. 1 in a perspective view and partly sectioned shows a countermass according to the invention.

The countermass 1 shown in FIG. 1 comprises an inner container 2 and an outer container 3. Within the inner container 2 a liquid binder 4 is provided. This liquid binder binds a liquid 5.

The inner container 2 is made of a non-rigid material such as a plastic foil or metal foil. An example of a plastic foil that can be used is a foil of silicon. The proposed foils are very flexible and can easily be adapted to almost any desirable shape. In one embodiment the inner container 2 is designed as a sealable bag. The outer container 3 has damping characteristics and is suitably made of foam plastic, such as EPP (expanded polypropylene), Frigolit or other porous materials. In the proposed embodiment the outer container comprises two rotary symmetrical sections 6 and 7. The sections 6, 7 are provided with grooves 8 facilitating the split into pieces. Furthermore the periphery of the container sections 6 and 7 can be provided with recesses, not shown, intended for cooperation with raisings 9 in the launcher tube 11 enclosing the countermass 1. When assembling the countermass 1, the inner container 2 with its liquid is put into the cavity 17 of a first one of the sections 6 or 7. The other section is then pressed against the first one with the cavities of the two sections 6, 7 facing each other. To keep the sections pressed against each other a glue joint, a clamping joint or any other suitable joint could be used.

The liquid used could be of any kind of liquid known as a suitable countermass liquid and preferably liquids with high specific gravity could be used. Fire extinguishing liquids is often preferred. A suitable material for the liquid binder is material having characteristics of Oasis type or other sponge like materials.

Figure 2:
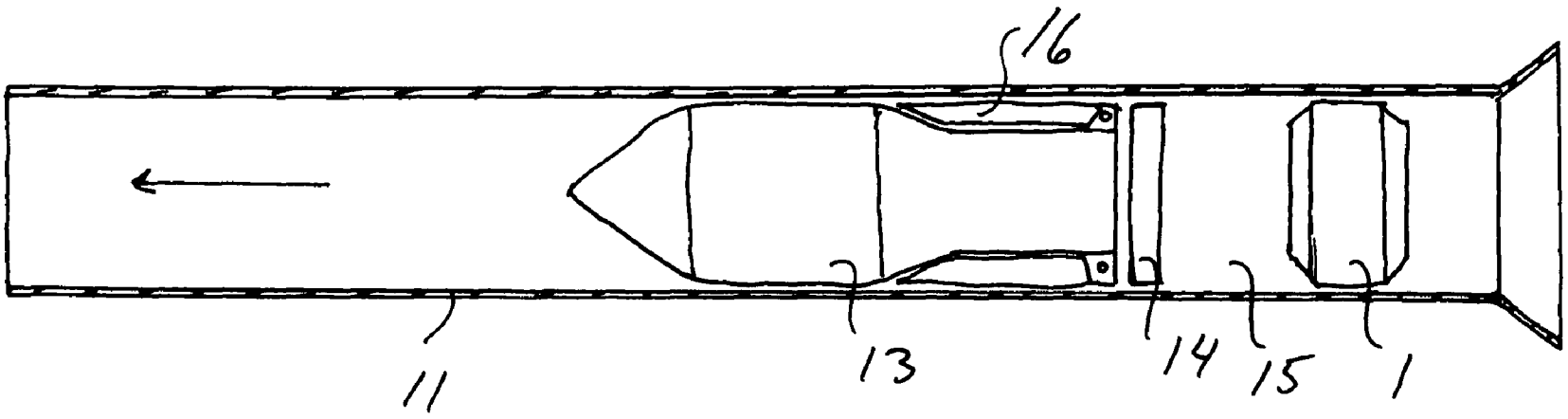
FIG. 2 shows a countermass weapon according to the invention in a longitudinal partly sectional view provided with a countermass according to the invention.
Figure 3:
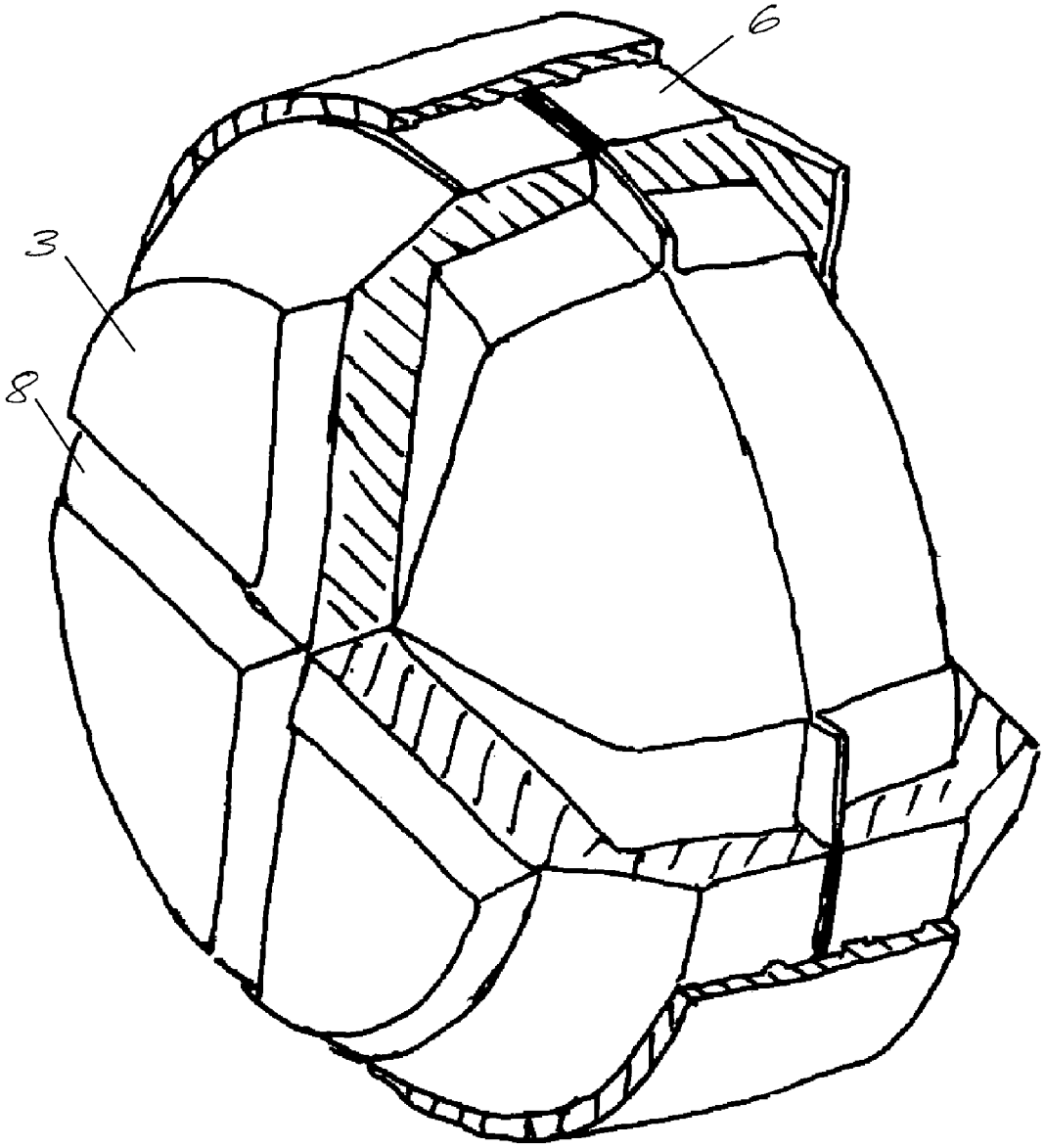
FIG. 3 shows a perspective and partly sectioned view of the opposite side of the embodiment shown in FIG. 1.

FIG. 2 shows a countermass weapon 10. The depicted weapon includes an open launcher tube 11. Though the launcher tube, until the moment of firing, can have its forward end covered with a disposable protective cap, not shown in the figure, and its rear end covered by a similar disposable bottom plate, this does not change the fact that the launcher tube during the launch itself operates as a launcher tube open in both ends. Inside the launcher tube there is housed viewed from the front end of the launcher tube to the rear end a rocket 13 a propellant charge 14, a pressure chamber 15 and a countermass 1. The rocket 13 as shown is provided with foldable fins 16.

The operation of the countermass weapon will now be described with references to FIG. 2. When an operator initiates firing of the weapon, the propellant charge 14 upon firing and combustion increases the pressure in the pressure chamber 15. The pressure increase accelerates the rocket forwards in the tube at the same time as the countermass 1 is accelerated backwards in the tube. When the rocket 13 has left the front end of the tube further propulsion means in the rocket are activated. During its backwards acceleration the countermass is subjected to such forces that the inner and outer containers close behind the rear end of the launcher tube 11 are divided into small pieces which are rapidly retarded. The liquid originally enclosed in the container is atomized behind the rear end of the weapon and extinguishes burning gases ejected from the rear end of the launcher tube.

The embodiment described above refers to a rocket application. It is however easy and within the scope of the invention to modify the weapon for other types of launchable units such as projectiles or shells.

We claim:

1. A countermass weapon, comprising:

a launcher tube open or openable in both ends, the launcher tube housing a launch able unit, a countermass comprising a first container enclosing a liquid, the first container comprising a non-rigid material and a peripheral flange, a pressure chamber, a propellant charge that upon firing and combustion of the charge in cooperation with the pressure chamber and the countermass accelerates the launch able unit forwards in the tube at the same time as the countermass accelerates backwards in the tube, and a second container that encloses and seals the first container, the second container comprising a front casing and a rear casing operatively coupled together by a joint, the second container comprising a material having damping characteristics, an exterior of the front casing comprising grooves configured to facilitate a splitting apart of the second container and an exterior of the rear casing comprising grooves configured to facilitate a splitting apart of the second container, wherein the peripheral flange is clamped between the front casing and the rear casing.

2. The countermass weapon according to claim 1, wherein the countermass is clamped in the launcher tube.

3. The countermass weapon according to claim 1, wherein the launch able unit comprises a rocket.

4. The countermass weapon according to claim 1, wherein the launch able unit comprises a projectile.

5. The countermass weapon according to claim 1, wherein the launchable unit comprises a rocket, a projectile, or a shell.

6. The countermass weapon according to claim 1, wherein each casing is essentially rotationally symmetrical.

7. The countermass weapon according to claim 1, wherein the joint between the front casing and the rear casing faces the launcher tube.

* * * * *